US005526101A

United States Patent [19]

Weed

[11] Patent Number: 5,526,101

[45] Date of Patent: Jun. 11, 1996

[54] TONER DISPENSING CARTRIDGE HAVING A NONROTATABLE TONER CUP AND A ROTATABLE SLEEVE-CAP

[75] Inventor: John M. Weed, Murrysville, Pa.

[73] Assignee: International Communications Materials, Inc., Connelsville, Pa.

[21] Appl. No.: 405,305

[22] Filed: Mar. 16, 1995

[51] Int. Cl.[6] ..... G03G 15/06

[52] U.S. Cl. ..... 355/260; 222/413

[58] Field of Search ..... 355/245, 246, 355/260, 250, 253, 259; 222/DIG. 1, 367, 167, 413, 412

[56] References Cited

U.S. PATENT DOCUMENTS

| | | | |
|---|---|---|---|
| 2,940,639 | 6/1960 | Winter | 222/412 X |
| 3,337,072 | 8/1967 | Del Vechio et al. | 414/411 |
| 4,091,765 | 5/1978 | Lowthorp et al. | 355/253 X |
| 4,611,730 | 9/1986 | Ikesue et al. | 222/167 |
| 4,688,926 | 8/1987 | Manno | 355/260 |
| 4,739,907 | 4/1988 | Gallant | 222/413 X |
| 4,878,603 | 11/1989 | Ikesue et al. | 222/167 |
| 5,030,997 | 7/1991 | Michlin et al. | 355/260 |
| 5,118,013 | 6/1992 | Mutou et al. | 222/171 |
| 5,128,724 | 7/1992 | Hayashi et al. | 355/245 |
| 5,235,389 | 10/1993 | Kikuchi et al. | 355/260 |
| 5,257,077 | 10/1993 | Peters, Jr. et al. | 355/260 |
| 5,280,324 | 1/1994 | Ono et al. | 355/260 |
| 5,293,913 | 3/1994 | Preszler | 355/260 X |
| 5,296,900 | 3/1994 | Saijo et al. | 355/260 |
| 5,307,129 | 4/1994 | Miura et al. | 355/260 |
| 5,374,977 | 12/1994 | Shiina et al. | 355/245 |
| 5,398,849 | 3/1995 | Smith et al. | 355/260 X |
| 5,455,662 | 10/1995 | Ichikawa et al. | 355/260 |
| 5,465,138 | 11/1995 | Jaskowiak et al. | 355/245 |

*Primary Examiner*—Arthur T. Grimley
*Assistant Examiner*—Shuk Y. Lee
*Attorney, Agent, or Firm*—Reed Smith Shaw & McClay

[57] ABSTRACT

A toner dispensing cartridge having a hollow toner cup with an open end portion to which a sleeve-cap is fitted. The sleeve-cap has at least one opening forming a mouth portion. The sleeve-cap is rotatable relative to the hollow toner cup. An agitator element disposed within the hollow toner cup, is connected to and rotatable by the sleeve-cap. With the hollow toner cup stationary, rotation of the sleeve-cap causes the agitator element to displace toner contained within the cartridge toward the mouth portion of the cartridge for egress of the toner through the mouth portion to toner receiving apparatus.

20 Claims, 5 Drawing Sheets

TONER DISPENSING CARTRIDGE HAVING A NONROTATABLE TONER CUP AND A ROTATABLE SLEEVE-CAP

FIELD OF THE INVENTION

The present invention relates to an apparatus for dispensing particulate matter, such as a powder or granulated material, into an electrophotographic type reproduction machine, or the like, and more particularly relates to a dispensing apparatus that operates to dispense a desired amount of toner into electrophotographic type reproduction machines.

BACKGROUND OF THE INVENTION

In typical electrophotographic type reproduction machines, during the course of each operating cycle, latent electrostatic images of the subject matter being reproduced are generated on a moving recording member. The recording member typically comprises a layer of photoconductive insulating material on a conductive backing, is given a uniform electric charge over its surface and is then exposed to the subject matter to be reproduced, usually by conventional projection techniques. This exposure creates an electrostatic latent image on the coating on the recording member. Following exposure, the latent electrostatic images on the recording member are developed at a developing station through the use of a developer mixture. In electrophotographic type reproduction machines that use dry developers for developing electrostatic images, the typically employed developer mixture includes a toner material and a carrier material. The developed image is then transferred at a transfer station to a support material, such as a sheet of paper. Subsequently, the developed image is fixed by any suitable means to provide a permanent image or reproduction.

Conventionally, image forming devices, such as laser printers and facsimile machines, employ an exposure system, a photocopier and a developer. An electrostatic latent image is formed on the photoreceptor by exposing it to laser light and the latent image is subsequently developed into a visible toner powder image. The visible toner image is then transferred from the photoreceptor onto a physical medium, such as a sheet of paper. The photoreceptor is typically a portable drum having a photosensitive surface. Processing stations are sequentially disposed around the photoreceptor and are fixed in position with respect to each other and to the photoreceptor. Such processing stations generally include a charging station, an exposure station, a developing station and a transfer station.

The charging station imparts an electrical charge onto the photosensitive surface of the photoreceptor and typically includes a corona charging wire. The electrical charge enables the toner image to be formed on the photoreceptor. The exposure station stations forms an electrostatic latent image on the photosensitive surface of the photoreceptor through an imaging light source (laser beam). The developing station develops the latent image on the photosensitive surface of the photoreceptor into the visible toner image and typically includes a supply of tone, such as powder, and a developing roller that transfers the toner powder onto the photoreceptor. The transfer station transfers the visible toner powder from the photoreceptor to the paper sheet, generally by use of a transfer wire.

In addition, a fixing device is provided which fixes or stabilizes the visible image on the paper sheet and enables the paper sheet to be handled without destroying the image. The fixing device typically works on the principle of heat and pressure rollers. A residual toner removing device, such as a cleaning blade, is also provided for removing toner that remains on the photoreceptor after the toner image has been transferred to the paper sheet. A discharge of pre-exposure station, such as an erase light, may also be provided to remove any residual electrical charge on the photoreceptor after the image has been transferred to the paper sheet. The discharge station is typically positioned between the toner removing device and the corona charging station.

During the development of such images, the toner portion of the developer mixture is depleted. In order to maintain the requisite portion of toner, fresh toner must be resupplied periodically. The means for supplying fresh toner must operate smoothly and consistently and must be reliable as well as leak-free for an electrophotographic machine or the like to operate properly.

Various types of toner resupply systems are known in the prior art as, for example, the toner cup or cartridge types shown by U.S. Pat. Nos. 3,337,072 (Del Vecchio et al.), 4,091, 765 (Lowthorp et al.), 5,118,013 (Mutou et al.) and 5,235,389 (Kikuchi et al.). All four of these prior art arrangements disclose a toner dispensing cartridge consisting of relatively rotatable inner and outer concentric cylinders, each with a toner dispensing opening or openings. The supply of fresh toner is held in the inner cylinder, and by rotating the inner cylinder relative to the outer cylinder, the discharge openings of each cylinder are brought into alignment thereby allowing for the dispensing of toner. To close the dispensing openings, the inner cylinder is again rotated relative to the outer cylinder such that the inner cylinder toner dispensing openings are closed by the inner surface of the outer cylinder.

One disadvantage of these concentric cylinder-type designs is that a deformation of either the inner or outer cylinder will make it impossible to achieve a desired smooth, rotational sliding motion between the outer surface of the inner cylinder and inner surface of the outer cylinder. Rather, such deformation will cause these portions of the cylinders to rub together. This interference between the cylinders will lead to abrading. As these portions of the cylinders become worn and damaged, the cylinders will no longer be able to rotate properly relative to each other thereby causing the improper dispensing of toner or lack thereof and/or leakage. Further, with the concentric cylinder design, large surface areas of the cylinders have the potential of interfering with each other due to deformation at any given time. The more surface contact between the cylinders, the greater the likelihood that a deformation in either cylinder will impede the proper functioning of the cartridge.

Similarly, U.S. Pat. No. 5,030,997 (Michlin et al.) discloses a toner dispensing and dispensing cartridge consisting of a cylinder having a plurality of toner dispensing ports spaced along its longitudinal axis. Disposed within the interior of and extending the length of the cylinder is a multi-cup scoop, which rotates causing the dispensing of toner as the cylinder rotates. Optionally, a stationary sleeve may be disposed around the rotatable cylinder. The sleeve is provided with a plurality of openings corresponding to the location of the toner dispensing ports of the cylinder so that as the cylinder rotates, the ports periodically come into alignment with the openings thereby permitting the discharge of toner. The same problems encountered with the concentric cylinder-type designs wherein the cylinders rotate relative to one another would also be encountered in the design taught by Michlin et al. wherein only the inner cylinder rotates while the outer sleeve remains stationary.

U.S. Pat. No. 4,688,926 (Manno) discloses a reproduction machine having a rotatable toner dispensing cartridge. The toner dispensing cartridge consists of a hollow tube or cylinder having a plurality of toner discharge ports extending along its longitudinal axis and a means for controlling the timing and dumping of the toner from the toner discharge ports into a developer housing.

In one embodiment of the toner dispensing cartridge, the cylinder is provided with a plurality of spaced slot-like toner discharge ports in its surface. A rotatable, elongated toner dumping or ejecting rod is provided to control the timing and dumping of the toner from the toner discharge ports into the developer housing. This rotatable ejecting rod consists of a series of flats or recesses and is held in tight contact with the exterior surface of the cylinder extending the length of the cylinder opposite the row of toner discharge ports. As the cylinder rotates so that the toner discharge ports face the developer housing, the ejecting rod is rapidly rotated from a position where the flats are facing the toner dispensing ports and picking up toner to a position where the flats are facing toward the interior of the developer station. As a result, the toner deposited on the flats is ejected into the developer housing.

In an alternative embodiment, the cylinder has a plurality of spaced circular discharge ports in its surface extending along its longitudinal axis and is provided with an elongated rigid strip-like slide plate. This slide plate has a series of toner discharge ports capable of mating with those of the cylinder and is sealably held in position on the exterior of the cylinder opposite the row of toner discharge ports. The reciprocal sliding movement of the slide plate, in a longitudinal direction along the exterior surface of the cylinder, causes the opening and closing of the toner discharge ports thereby controlling the dispensing of toner.

The problem with this type toner resupply cartridge, is that it is mechanically complex and somewhat cumbersome. This design contains several moving parts, which increases the opportunity for malfunction and necessitates careful quality control to protect against or minimize product failure. The added quality control needed can be overly time consuming as well as add to the expense of production.

U.S. Pat. Nos. 4,611,730 and 4,878,603 disclose a toner replenishing devise that incorporates a cartridge comprising a generally cylindrical main body having opposite first and second ends, the first end being closed while the second end is open and comprises a mouth for the egress of toner. A helix-shaped guide rib is formed integrally with and in interior surface of the main body. The helix-shaped guide rib extends from the closed end to the mouth of the main body. A ring-type gear member surrounds the main body and is secured thereto proximate to the mouth for rotating the main body. The gear is positioned to mesh with a pinion gear provided by the toner replenishing device for driving the gear and thereby rotating the entire cartridge. As the cartridge rotates, the helix-shaped guide rib advances the toner toward and through the mouth into a toner transport path leading to the toner storage area.

Thus, it is desirable to provide a toner dispensing cartridge that is simply constructed from a minimum number of parts, easily operated, leak-free and operational with minimal cylinder degradation.

The invention disclosed herein has accomplished this by providing a toner dispensing cartridge having a hollow toner cup with an open end portion to which a sleeve-cap is fitted. The sleeve-cap has an opening forming a mouth portion and is rotatable relative to the hollow toner cup. A helix-shaped agitator element resides within the hollow toner cup and is connected to the sleeve-cap for rotation therewith. With the hollow toner cup stationary, rotation of the sleeve-cap causes the helix-shaped agitator element to displace the toner contained within the cartridge, toward the mouth portion of the cartridge for egress of toner through the mouth portion. This design allows efficient displacement of the toner thereby providing smooth, reliable, consistent and leak-free operation of the toner dispensing cartridge.

SUMMARY OF THE INVENTION

The toner dispensing cartridge of the present invention is used for supplying fresh particulate matter in electrophotographic machines and the like. The toner dispensing cartridge comprises a generally cylindrical toner cup that stores a quantity of particulate matter such as toner, developer, and the like.

The toner cup comprises a substantially hollow toner cup comprising a generally cylindrical wall having a longitudinal axis, a closed end and opposite thereto an end portion including an open end. In addition, a sleeve-cap is fitted over the end portion of the cylindrical wall at the open end, the sleeve-cap being rotatable relative to toner cup. The sleeve-cap has at least one opening communicating with the open end and forming a mouth portion for the egress of toner. An agitator element is disposed within the hollow toner cup and is secured to and rotatable with the sleeve-cap. Means is provided for preventing rotation of the hollow toner cup about its longitudinal axis. Gear means comprising an external flange with gear teeth is disposed on and surrounds the sleeve-cap for rotatably driving the sleeve-cap and the agitator element relative to the hollow toner cup. Rotation of the agitator element causes toner contained within the hollow toner cup to be displaced toward the open end for egress through the mouth portion.

BRIEF DESCRIPTION OF THE PRESENTLY PREFERRED EMBODIMENTS

Figure 1:
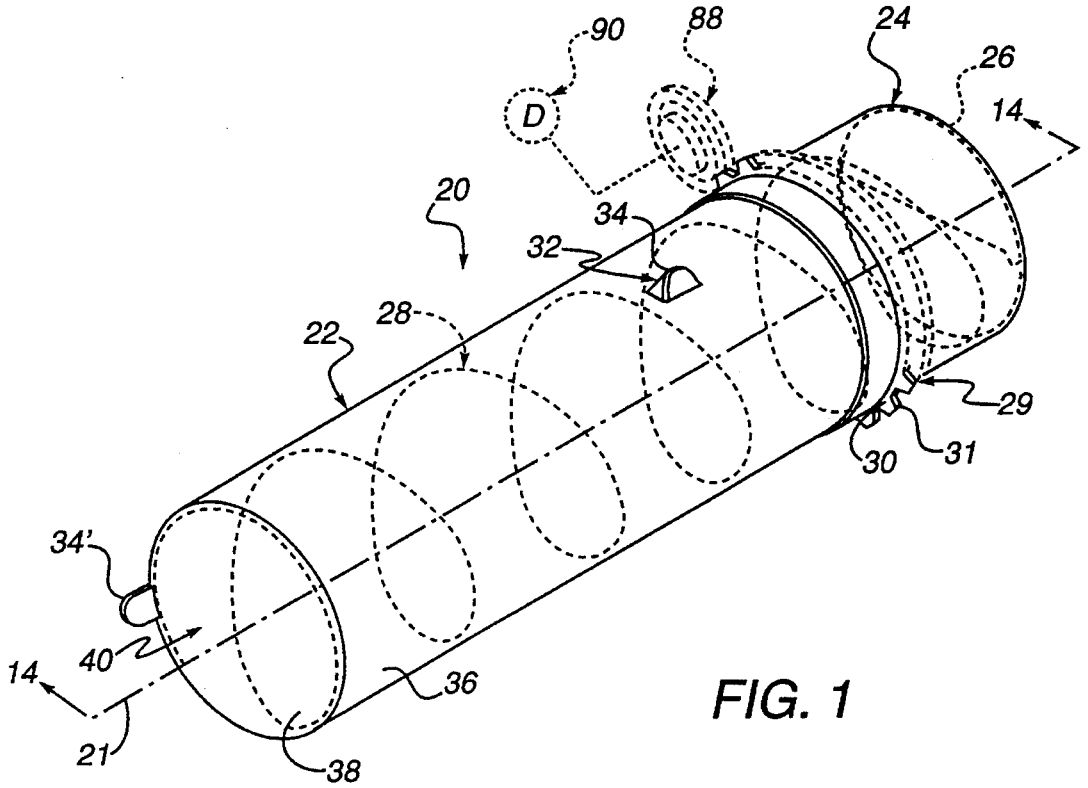
FIGS. 1 is a perspective view of the toner dispensing cartridge.

FIG. 1 illustrates a toner dispensing cartridge 20 having a longitudinal axis 21. The cartridge 20 comprises a substantially hollow toner cup 22 having an open end 26 over which a sleeve-cap 24 is fitted. When the toner dispensing cartridge 20 is in use, the hollow toner cup 22 remains stationary while the sleeve-cap 24 is rotated relative to the hollow toner cup 22. An agitator element 28, shown in phantom lines, is disposed within the hollow toner cup 22 and is secured to the sleeve-cap 24 for rotation therewith. Gear means 29 surrounds the sleeve-cap 24 for rotatably driving the sleeve-cap 24 and the agitator element 28 causing toner contained within the hollow toner cup 22 to be displaced toward the open end 26. Means for preventing rotation of the hollow toner cup 22 about the longitudinal axis 21 is provided. The means for preventing rotation may comprise a tab or stop member 34 projecting outwardly from the outer surface 36 of the hollow toner cup 22. The tab or stop members 34, 34' are positioned to engage a cartridge support element (not illustrated) associated with a toner replenishing device.

Figure 2:
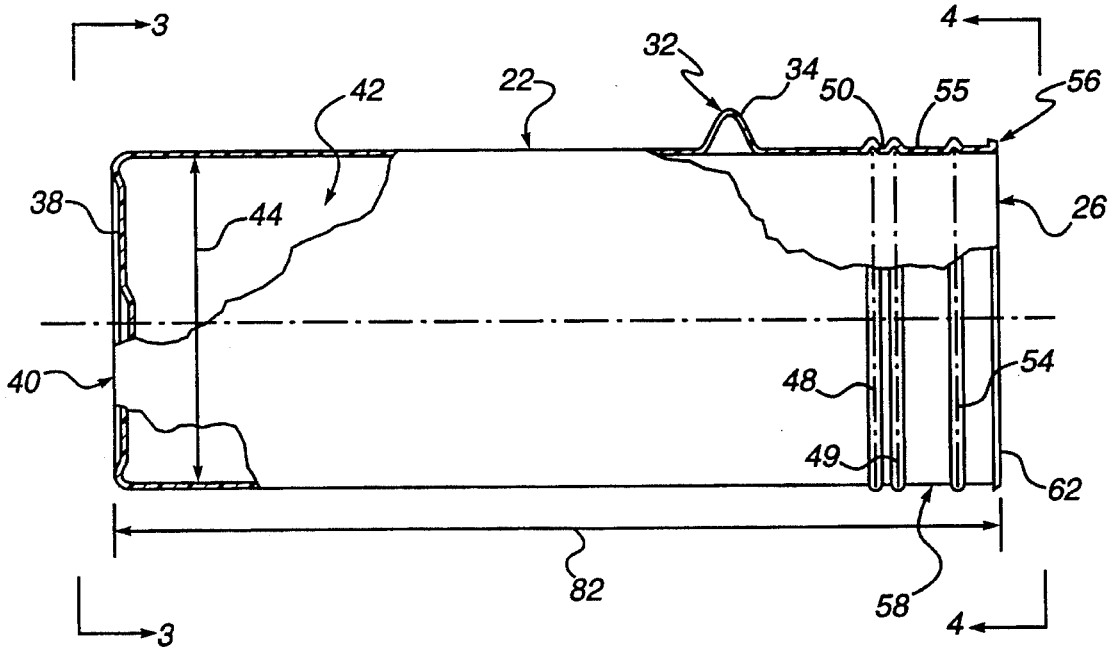
FIG. 2 is a side view of a hollow toner cup with portions broken away to show detail.
Figure 3:
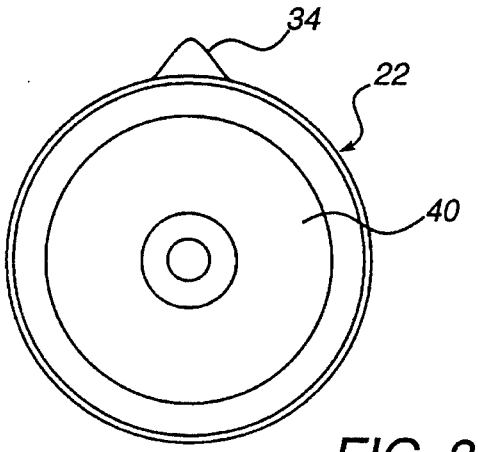
FIG. 3 is an elevation view of a closed end of the hollow toner cup of FIG. 2 as viewed from the line 3—3 of FIG. 2.
Figure 4:
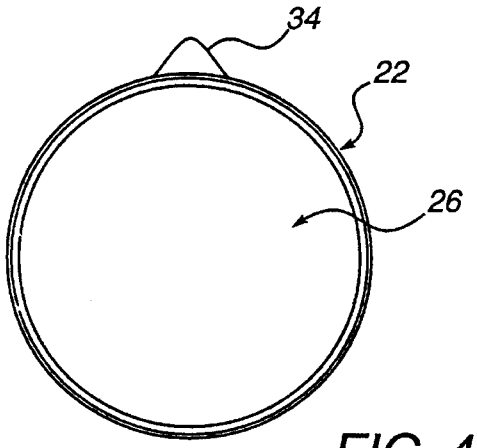
FIG. 4 is an elevation view of the opposite end or open end of the hollow toner cup of FIG. 2 as viewed form the line 4—4 of FIG. 2.

Referring to FIGS. 2 through 4, the hollow toner cup 22 preferably is formed from plastic material, such as, high density polyethylene and polypropylene. The toner cup 22 has a relatively thin wall and has a hollow interior 42 adapted to contain toner. The toner cup 22 has an inside diameter indicated at 44 which is slightly greater than the outer diameter 46 (FIG. 12) of the agitator element 28.

Figure 5:
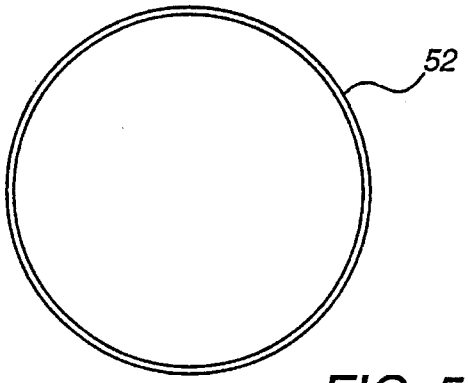
FIG. 5 is an elevation view of an O-ring used as a gasket in the present toner dispensing cartridge.

The hollow toner cup 22 additionally is provided with spaced-apart circumferential ribs 48, 49 adjacent to the open end 26. The circumferential ribs 48, 49 being spaced-apart, present a groove 50 adapted to receive a gasket such as, the O-ring 52 illustrated in FIG. 5. As will be described, the O-ring 52 will be disposed between overlapped portions of the sleeve-cap 24 and the hollow toner cup 22 thereby providing an adequate seal between the sleeve-cap 24 and the hollow toner cup 22 while allowing the sleeve-cap 24 to rotate about the longitudinal axis 21.

The hollow cylinder 22 is additionally provided with another circumferential rib 54 disposed between end of the hollow toner cup 22 and the ribs 48. The circumferential rib 54 serves as a bearing surface the provides stability to the rotation of the sleeve-cap 24.

Figure 6:
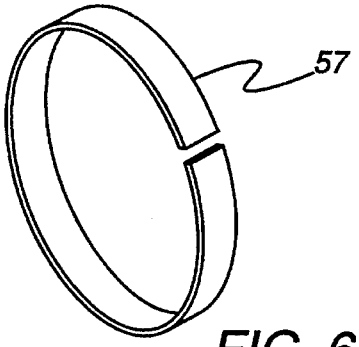
FIG. 6 is an isometric view of a strip of foamed material used a gasket in the present toner dispensing cartridge.
Figure 7:
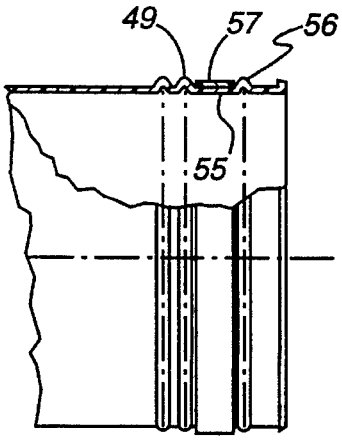
FIG. 7 is a fragmentary side view, partly in cross-section, illustrating the use of the gasket strip of FIG. 6.

Alternatively, the gasket may comprise a gasket strip 57 (FIG. 6) a foamed insulate material, adapted to be received in the circumferential space (FIG. 2) provided between the circumferential ribs 49, 54. FIG. 7 illustrates the use of the gasket strip 57 in the circumferential space 55.

The toner dispensing cartridge 20 also includes connecting means 56 (FIG. 2, 9 and 10) for retaining the sleeve-cap 24 fitted, that is, connected to the end portion 58 (FIG. 2) of the hollow toner cup 22. The means 56 is comprised of two components, that is, a circumferential flange 62 (FIGS. 2 and 4) extending outwardly from the exterior surface 36 of the hollow toner cup 22 at the open end 26; and a series of cusps 64 (FIGS. 8–10) are provided on the interior surface 60 of the sleeve-cap 24 and are preferably uniformly spaced thereabout. As will be described, the cusps 64 are adapted to engage the circumferential flange 62 when the sleeve-cap 24 is fitted over the end portion 58 of the hollow toner cup 22.

Alternatively, the cusps 64 may be provided on the exterior surface 36 of the hollow toner cup 22 while the flange 62 may be provided on the interior surface 60 of the sleeve-cap 24.

Figure 8:
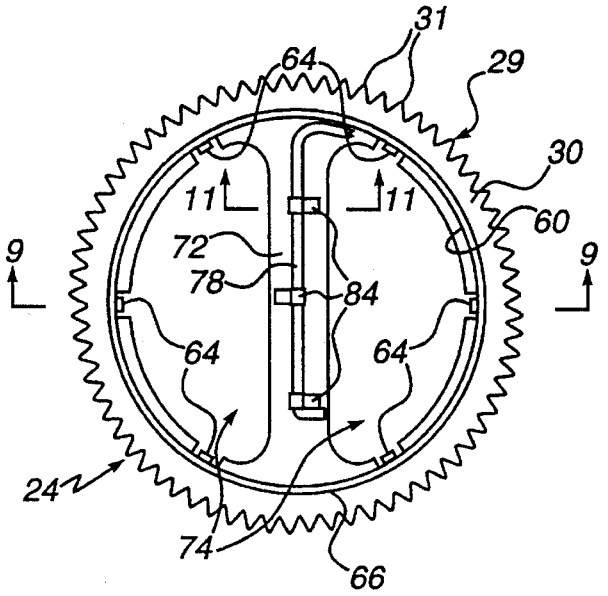
FIG. 8 is an elevation view of a sleeve-cap.
Figure 9:
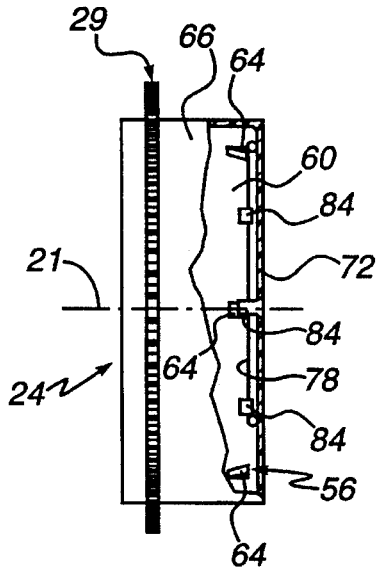
FIG. 9 is a side view of the sleeve-cap of FIG. 8 with portions broken away to show detail.
Figure 10:
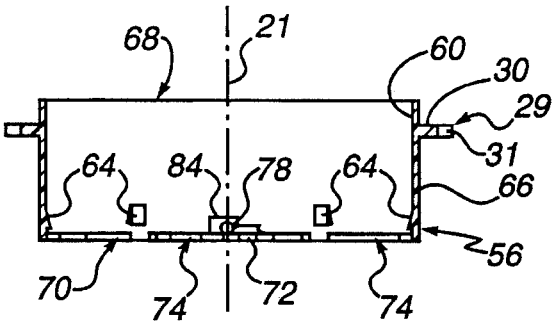
FIG. 10 is cross-sectional view, taken along the line 10—10 of FIG. 8.
Figure 14:
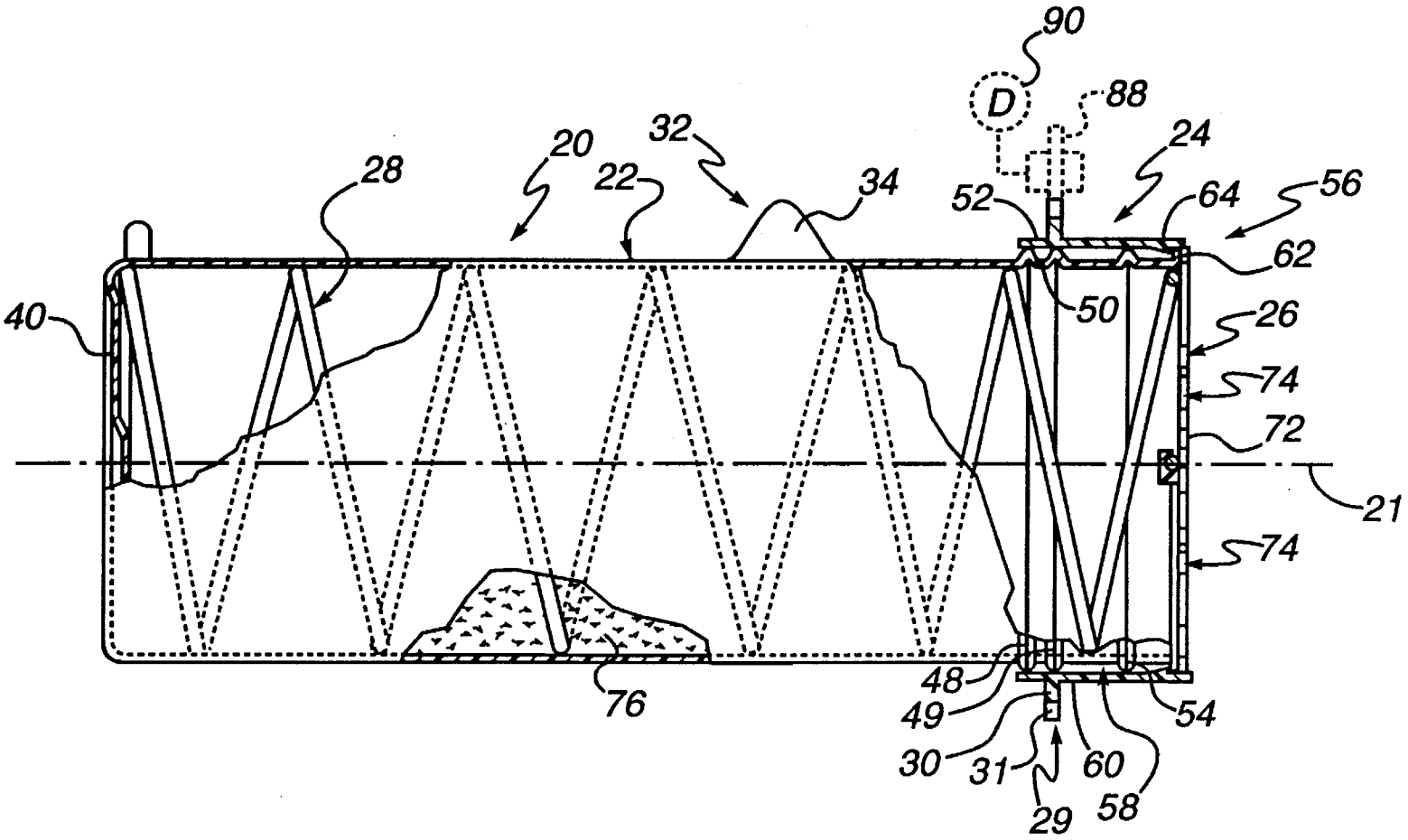
FIG. 14 is a cross-sectional view, taken along the line 14—14 of FIG. 1.

Referring to FIGS. 8–10, the sleeve-cap 24 may be formed from high impact polystyrene or ABS. The sleeve-cap 24 comprises a cylindrical wall 66 from which extends gear means 29. The gear means 29 comprises a circumferential external flange 30 having gear teeth 31. As best seen in FIG. 10, the sleeve-cap 24 has an open end 68 and opposite thereto, a partially closed end 70. The open end 68 receives the end portion 58 of the hollow toner cup 22. The partially closed end 70 includes a cross piece 72 which divides the partially closed end 70 into openings 74 which, as shown in FIG. 14, communicate with the open end 26 of the hollow toner cup 22, thereby forming a mouth portion for the egress of toner 76 illustrated in FIG. 14. The gear means 29 may be formed integrally with the cylindrical wall 66. Alternatively, the gear means 29 may be formed separately and mounted to the cylindrical wall 60 for rotatively driving the sleeve-cap 24.

Figure 12:
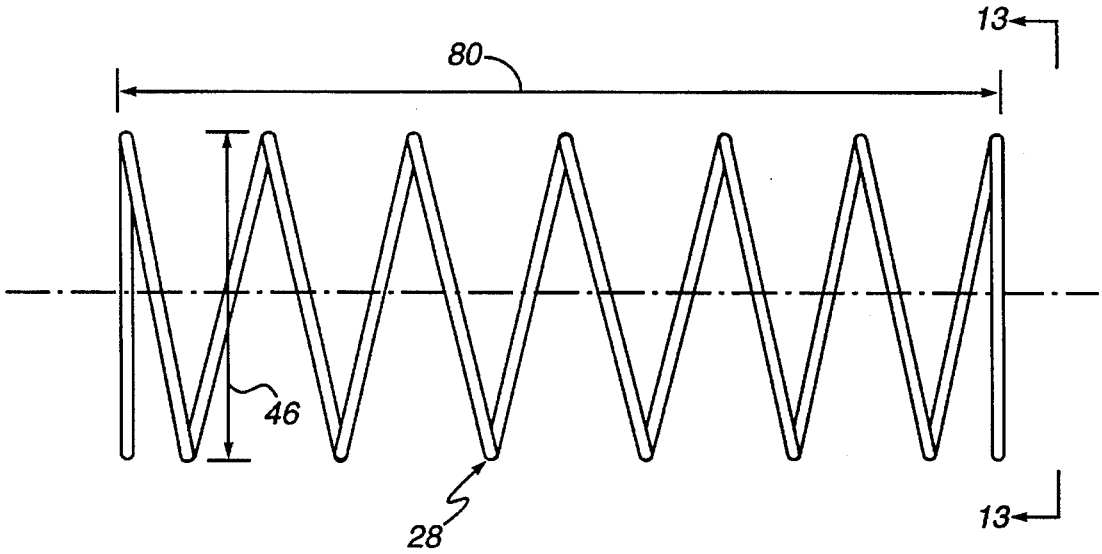
FIG. 12 is a side view of an agitator element.
Figure 13:
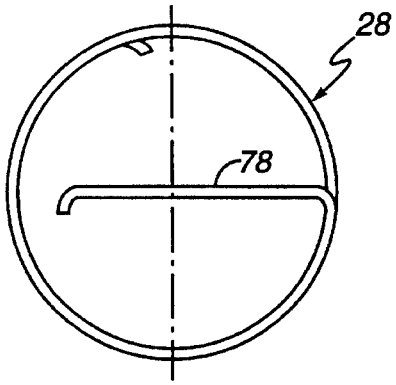
FIG. 13 is and end view of the agitator element of FIG. 12 as view from the line 13—13.

Referring to FIGS. 12 and 13, the agitator element 28 comprises a helix-shaped element, see FIG. 1. The agitator element 28 is formed from flexible material, such as, stainless steel or high density polyethylene. In addition, the agitator element 28 has an overall length indicated by the dimension line 80 which is greater than the interior length of the hollow toner cup 22 indicated by the dimension line 82 in FIG. 2. The greater length of the agitator element 28 allows is to extend from the end of the hollow toner cup 22 to the opening 74 in the sleeve-cap 24.

Figure 11:
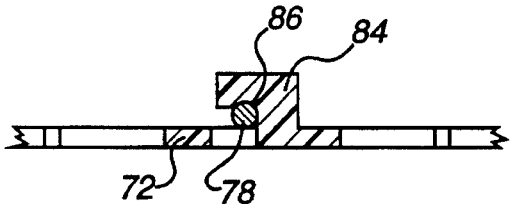
FIG. 11 is cross-sectional view, taken along the line 11—11 of FIG. 8.

The agitator element 28 includes an end segment 78 (FIG. 11) that is disposed along a diameter of the agitator element 28. As shown in FIGS. 8–10, the cross piece 72 of the sleeve-cap 24, is provided with plural hooks 84. As best shown in FIG. 9, each hook 84 presents a recess 86 which receives the end segment 78 of the agitator element 28. In order to retain the end segment 78 connected to the sleeve-cap 24, the hooks 84 are oppositely disposed, that is, the center hook 84 one faces to the left of FIG. 8 while the outer hooks 84 face to the right of FIG. 8. As can be seen in FIG. 14, the sleeve-cap 24 and the hollow toner cup 22 has overlapped portions comprising the cylindrical wall 66 and the end portion 58, respectively. The O-ring 52 resides within the groove 50 formed between the circumferential ribs 48 and is disposed between the overlapped portions 66, 58. Thus, the O-ring provides an adequate seal between the sleeve-cap 24 and the hollow toner cup 22 and yet the sleeve-cap 24 is rotatable about the longitudinal axis 21. In addition, the circumferential flange 62 of the hollow toner cup 22 is engaged with the cusps 64 of the sleeve-cap 24 thereby providing retaining the sleeve-cap 24 rotatably connected to the hollow toner cup 22.

The arrangement is such that the toner dispensing cartridge 20 may be introduced into an electrophotographic type reproduction machine at which time the gear means 29 will be engaged with and driven by a pinion gear 88 schematically illustrated in dotted outline in FIG. 14. A suitable drive 90 also schematically illustrated in dotted outline in FIG. 14, is provided by the electrophotographic type reproduction machine. As the sleeve-cap 24 is rotated, the agitator element 28 also is rotated. Consequently the agitator element 28 causes the toner 76 contained within the hollow toner cup 22 to be displaced toward the open end 26 of the hollow toner cup 22 and through the openings 74 in the sleeve-cap 24 to a toner receiving apparatus (not illustrated). It is to be understood that the hollow toner cup 22 is maintained fixed, that is, stationary, while the sleeve-cap 24 and the agitator element 28 are rotated.

I claim:

1. A toner dispensing cartridge comprising:

a substantially hollow toner cup comprising a generally cylindrical wall having a longitudinal axis, a closed end and opposite thereto an end portion including an open end;

a sleeve-cap fitted over said end portion of said cylindrical wall at said open end, said sleeve-cap being rotatable relative to hollow toner cup, said sleeve-cap having at least one opening communicating with said open end and forming a mouth portion for egress of toner;

an agitator element disposed within said hollow toner cup, said agitator element being secured to and rotatable with said sleeve-cap;

means for preventing rotation of said hollow toner cup about said longitudinal axis; and gear means disposed on and surrounding said sleeve-cap for rotatably driving said sleeve-cap and said agitator element relative to said hollow toner cup, rotation of said agitator element causing toner contained within said hollow toner cup to be displaced toward said open end for egress through said mouth portion.

2. The toner dispensing cartridge as defined in claim 1 including a gasket disposed between the overlapped portions of said sleeve-cap and said hollow toner cup.

3. The toner dispensing cartridge as defined in claim 2 wherein said gasket comprises an O-ring.

4. The toner dispensing cartridge as defined in claim 2 wherein said gasket comprises a strip of sealant material.

5. The toner dispensing cartridge as defined in claim 1 including:

means for retaining said sleeve-cap connected to said end portion.

6. The toner dispensing cartridge as defined in claim 5 wherein said hollow toner cup and said sleeve-cap present confronting interior and exterior surfaces;

said means for retaining comprising:

cusps extending from one of said surfaces toward the other of said surfaces; and a circumferential flange extending from the other of said surfaces and engaged with said cusps.

7. The toner dispensing cartridge as defined in claim 1 wherein said means for preventing rotation comprises a projection formed on an outer surface of said hollow toner cup.

8. The toner dispensing cartridge as defined in claim 1 wherein said agitator element comprises a helix-shaped element formed from flexible material.

9. The toner dispensing cartridge as defined in claim 8 wherein said agitator element has an overall length that is greater than that of said hollow toner cup and is compressed between said hollow toner cup and said sleeve-cap.

10. The toner dispensing cartridge as defined in claim 1 wherein said gear means is formed integrally with said sleeve-cap.

11. The toner dispensing cartridge as defined in claim 1 wherein said agitator element has an end segment connected to and rotatable with said sleeve-cap.

12. A toner dispensing cartridge for use with a toner replenishing device for feeding toner from said toner dispensing cartridge into said toner replenishing device, comprising:

a substantially hollow toner cup containing a quantity of toner, said hollow toner cup comprising a generally cylindrical wall having a longitudinal axis, and having a closed end and opposite thereto an end portion including an open end;

a sleeve-cap fitted over said end portion of said cylindrical wall at said open end, said sleeve-cap being rotatable relative to said end portion of said cylindrical wall, said sleeve-cap having at least one opening communicating with said open end and forming a mouth portion generally perpendicular to said longitudinal axis for egress of said toner;

an agitator element disposed within said hollow toner cup, said agitator element being secured to and rotatable with said sleeve-cap;

means for preventing rotation of said hollow toner cup about said longitudinal axis gear means disposed on and surrounding said sleeve-cap for rotatably driving said sleeve-cap and said agitator element relative to said hollow toner cup, rotation of said agitator element causing said toner within said hollow toner cup to be displaced toward said open end for egress through said mouth portion.

13. The toner dispensing cartridge as defined in claim 12 including a gasket disposed between the overlapped portions of said sleeve-cap and said hollow toner cup.

14. The toner dispensing cartridge as defined in claim 13 wherein said gasket comprises an O-ring.

15. The toner dispensing cartridge as defined in claim 12 wherein said hollow toner cup has an outer surface and said means for preventing rotation comprises a projection formed on the outer surface of said hollow toner cup.

16. The toner dispensing cartridge as defined in claim 12 including:

means for retaining said sleeve-cap connected to said end portion.

17. The toner dispensing cartridge as defined in claim 16 wherein said hollow toner cup and said sleeve-cap present confronting interior and exterior surfaces;

said means for retaining comprising:

cusps extending from one of said surfaces toward the other of said surfaces; and a circumferential flange extending from the other of said surfaces and engaged with said cusps.

18. The toner dispensing cartridge as defined in claim 12 wherein said agitator element comprises a helix-shaped element formed from flexible material.

19. The toner dispensing cartridge as defined in claim 18 therein said agitator element has an overall length that is greater than that of said hollow toner cup and is compressed in use.

20. The toner dispensing cartridge as defined in claim 12 wherein said gear means is formed integrally with said sleeve-cap.

* * * * *